US006134788A

United States Patent [19]

Chen et al.

[11] Patent Number: 6,134,788

[45] Date of Patent: Oct. 24, 2000

[54] TOOL HOLDER

[76] Inventors: Tsai-Ching Chen; Chiu-Man Chang-Kao, both of P.O. Box 63-247, Taichung, Taiwan

[21] Appl. No.: 09/343,181

[22] Filed: Jun. 30, 1999

[51] Int. Cl.[7] ..... B26B 1/04; B26B 11/00

[52] U.S. Cl. ..... 30/125; 30/143; 30/157; 30/161

[58] Field of Search ..... 30/125, 143, 157, 30/160, 161, 156, 519, 331; 7/118–120

[56] References Cited

U.S. PATENT DOCUMENTS

| | | | |
|---|---|---|---|
| 3,896,546 | 7/1975 | Hildebrandt | 30/157 |
| 4,660,284 | 4/1987 | DaCarolis | 30/157 |
| 5,661,908 | 9/1997 | Chen | 30/125 |
| 5,916,277 | 6/1999 | Dallas | 30/143 X |

*Primary Examiner*—Douglas D. Watts
*Attorney, Agent, or Firm*—Rosenberg, Klein & Lee

[57] ABSTRACT

A tool holder and tools combination includes a base including a first end and a second end. A head is formed on the second end of the base and includes a first compartment for receiving spare tools and a second compartment for receiving a service tool when not in use. Each of the tools includes an end having an engaging hole and a slit extended from the engaging hole to an end edge of the tool. A fixing seat is pivotally mounted to the head and includes a groove for securely holding the end of the service tool. The fixing seat includes a transverse hole having a first part that slidably receives a latch member and a second part that slidably receives a push pin, while the engaging hole of the service tool locates between the first part and the second part. The push pin has a first end secured to the latch member to move therewith and a second end for manual operation. The engaging hole of each tool is sized to be smaller than a diameter of the latch member and greater than a diameter of the push pin. A spring is provided for biasing the latch member to a position received in the engaging hole of the service tool, thereby preventing removal of the service tool. The push pin is manually operable to cause the latch member out of the engaging hole of the service tool, thereby allowing removal of the service tool from the fixing seat.

19 Claims, 8 Drawing Sheets

TOOL HOLDER

BACKGROUND OF THE INVENTION

1. Field of the Invention

The present invention relates to a tool holder for different blades such as cutting blades saw blades, or the like.

2. Description of the Related Art

U.S. Pat. No. 5,661,908 to Chen issued on Sep. 2, 1997 discloses a multifunctional foldable saw in which a rotary switch 23 is turned during replacement for the blade 22. Although the rotary switch 23 provides a simple engaging function, it still tends to be disengaged if subjected to a larger force. In addition, a rear cover 5 is required for storage and retrieval of the blade 22, and the operation is convenient to the user.

The present invention is intended to provide a tool holder that mitigates and/or obviate the above problems.

SUMMARY OF THE INVENTION

It is a primary object of the present invention to provide an improved tool holder for receiving different blades to allow easy and rapid replacement of the blades.

In accordance with a first aspect of the invention, a tool holder and tools combination comprises:

a base including a first end and a second end;

a head formed on the second end of the base and including a first compartment for receiving spare tools and a second compartment for receiving a service tool when not in use, each of the tools including an end having an engaging hole and a slit extended from the engaging hole to an end edge of the tool;

a fixing seat pivotally mounted to the head, the fixing seat including a groove for securely holding the end of the service tool; and a pivotal means including a latch member slidably mounted in the head and a push pin having a first end secured to the latch member to move therewith and a second end for manual operation, the engaging hole of each said tool being sized to be smaller than a diameter of the latch member and greater than a diameter of the push pin;

means for biasing the latch member to a position received in the engaging hole of the service tool, thereby preventing removal of the service tool, wherein the push pin is manually operable to cause the latch member out of the engaging hole of the service tool, thereby allowing removal of the service tool from the fixing seat.

The head includes a pair of spaced lugs having a space therebetween for pivotally receiving the fixing seat. The lugs have aligned holes through which the latch member and the push pin slidably extend, respectively. The fixing seat includes a bulge pivotally held between the lugs and including a transverse hole through which the latch member and the push pin extend. The bulge includes a plurality of positioning grooves, and further comprises a positioning means for retaining the end of the service tool in place. The head includes a resilient member on an upper side thereof and a track means formed thereon. The positioning means is slidably mounted to the track means and slidable between an operative position that retains the fixing seat in place and an inoperative position that allows the fixing seat to pivot relative to the head. The resilient member includes a catch for securely engaging with one of the positioning grooves when the positioning means is moved to the operative position. The catch is releasably engaged with a selected one of the positioning grooves to allow pivotal movement of the fixing seat relative to the head when the positioning means is in the inoperative position. The track means includes a pair of slots defined in two lateral sides of the head, respectively. The positioning member includes two lateral sides each having a hook for slidingly engaging with an associated slot of the head.

A cover has an end pivotally connected with the first end of the base. The cover includes a tenon on the other end thereof, and wherein the second end of the base includes a mortise for releasably engaging with the tenon. The first compartment is divided by a separation wall into two subcompartments, and the second compartment is defined in an underside of the separation wall. The fixing seat includes a transverse hole having a first part that slidably receives the latch member and a second part that slidably receives the push pin, while the engaging hole of the service tool locates between the first part and the second part.

In accordance with a second aspect of the invention, a tool holder and tools combination comprises:

a base including a first end and a second end;

a head formed on the second end of the base and including a first compartment for receiving spare tools and a second compartment for receiving a service tool when not in use, the head including a pair of spaced lugs having a space therebetween and aligned holes, a resilient member on an upper side thereof and a track means formed thereon;

a fixing seat including a bulge with a pivotal hole, the bulge being pivotally mounted in the space of the head, the bulge including a plurality of positioning grooves, the fixing seat including a groove for securely holding an end of the blade; and a positioning means for retaining the end of the service tool in place, the positioning means being slidably mounted to the track means and slidable between an operative position that retains the fixing seat in place and an inoperative position that allows the fixing seat to pivot relative to the head, wherein the resilient member includes a catch for securely engaging with one of the positioning grooves when the positioning means is moved to the operative position, and wherein the catch is releasably engaged with a selected one of the positioning grooves to allow pivotal movement of the fixing seat relative to the head when the positioning means is in the inoperative position.

Each of the tools includes an end having an engaging hole and a slit extended from the engaging hole to an end edge of the tool. A pivotal means includes a latch member slidably mounted in the head and a push pin having a first end secured to the latch member to move therewith and a second end for manual operation. The engaging hole of each tool is sized to be smaller than a diameter of the latch member and greater than a diameter of the push pin. Means is provided for biasing the latch member to a position received in the engaging hole of the service tool, thereby preventing removal of the service tool. The push pin is manually operable to cause the latch member out of the engaging hole of the service tool, thereby allowing removal of the service tool from the fixing seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
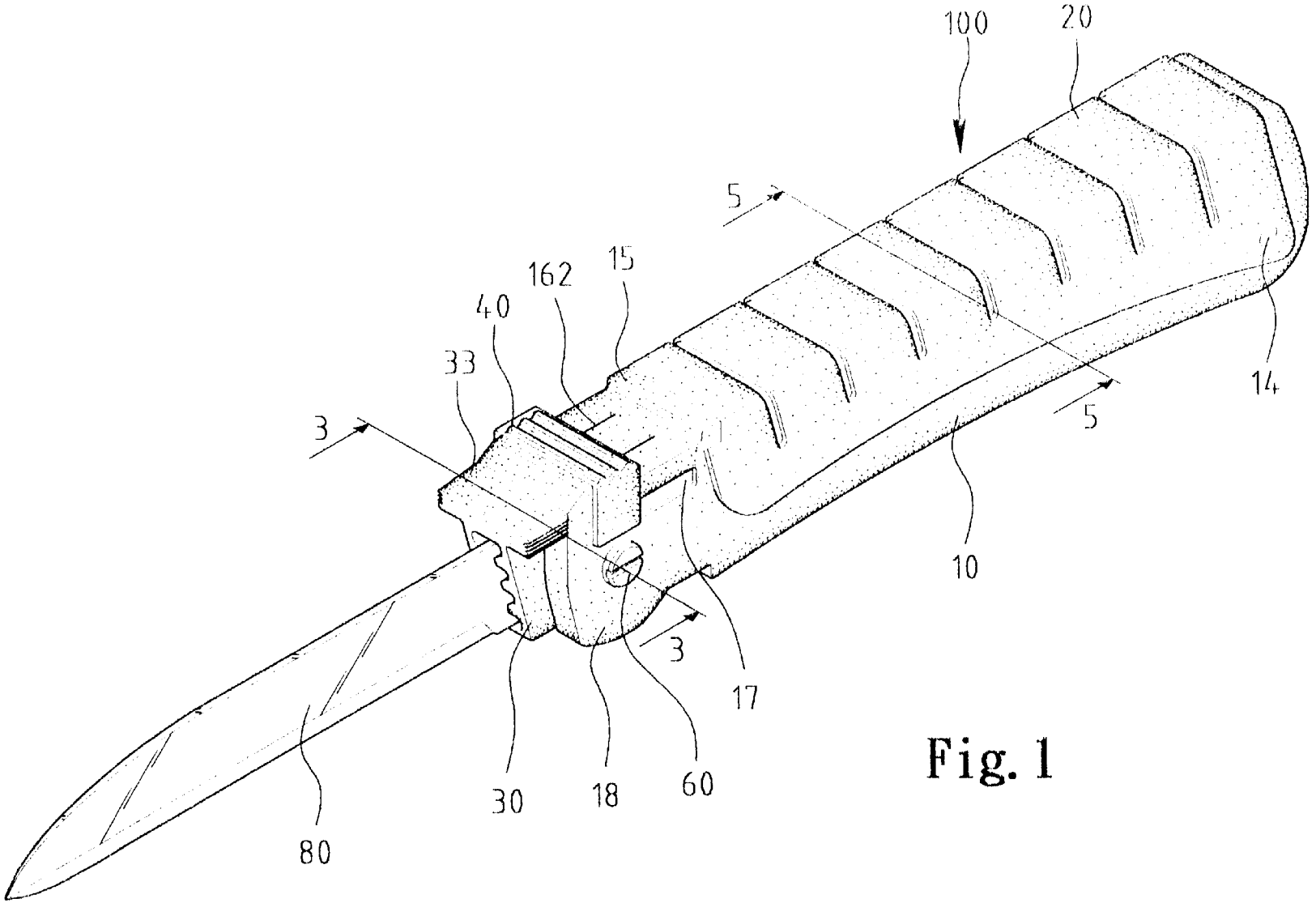
FIG. 1 is a perspective view of a tool holder in accordance with the present invention.
Figure 2:
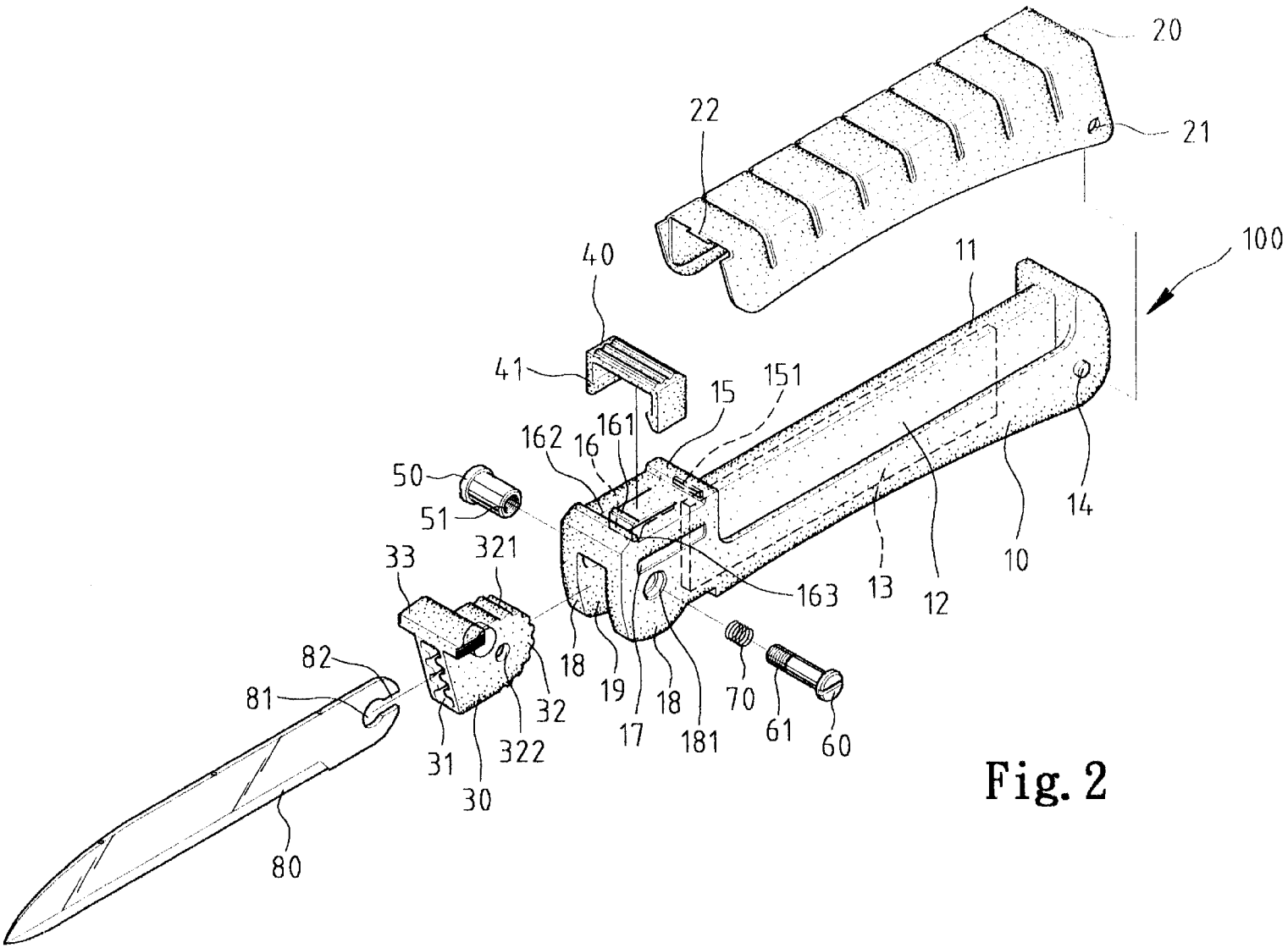
FIG. 2 is an exploded perspective view of the tool holder in accordance with the present invention.
Figure 4:
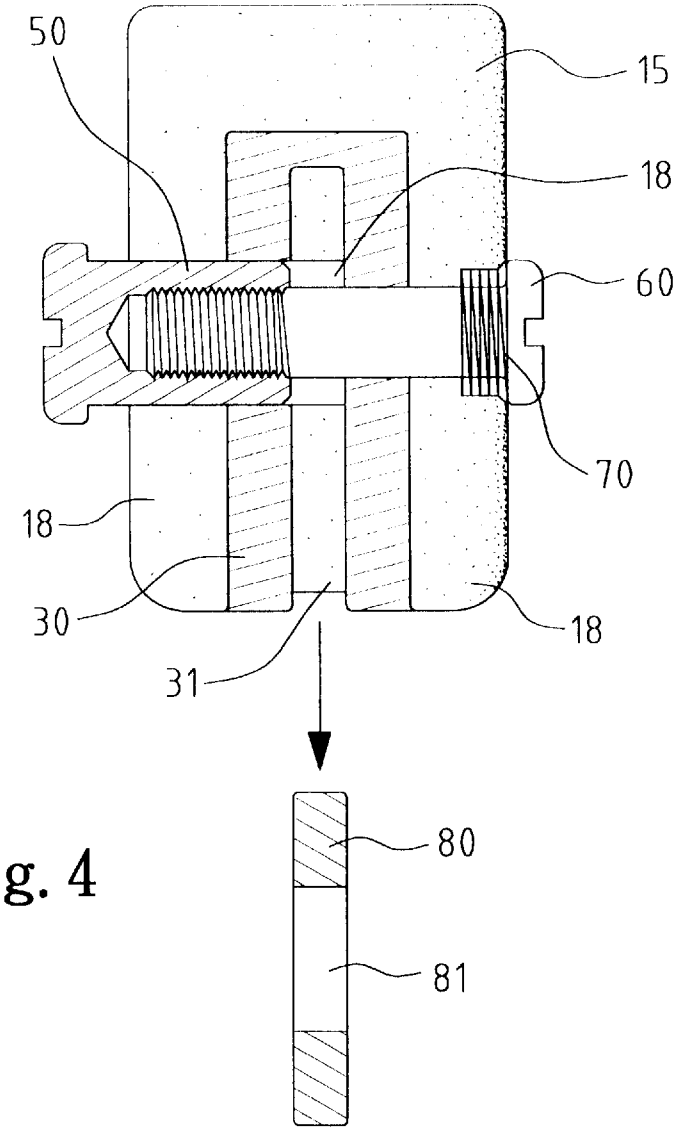
FIG. 4 is a sectional view similar to FIG. 3, wherein the blade is disengaged.

Referring to FIGS. 1 through 10 and initially to FIGS. 1 and 2, a tool holder in accordance with the present invention generally includes a tool holder that includes a handle 100 consisting of a cover 20 and a base 10. A fixing seat 30 is secured to an end of the handle 100 to allow rapid replacement of blades and to provide improved structure.

Figure 5:
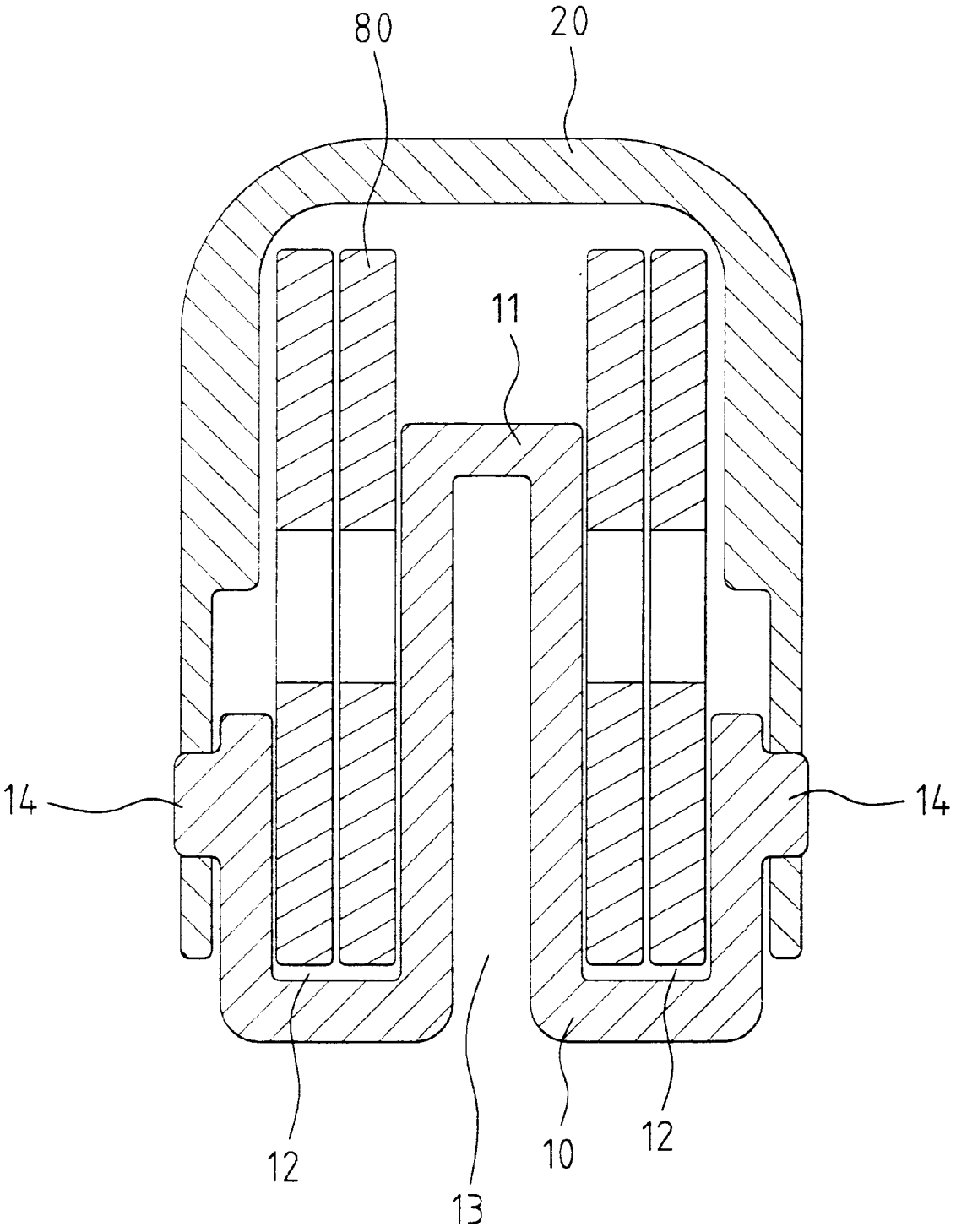
FIG. 5 is a sectional taken along line 5—5 in FIG. 1.

The base 10 includes a separation wall 11 to separate two compartments 12 located on both sides of the separation wall 11 and defined in an upper side of the base 10. The compartments 12 are provided to receive spare blades 80 of different functions, as shown in FIG. 5. In addition, a blade receiving compartment 13 is defined in an underside of the separation wall 11 for receiving a blade when not in use. An end of the base 10 further includes two knurls 14 respectively on two lateral sides thereof for pivotal connection with pivotal holes 21 defined in an end of the cover 20. A head 15 is formed on the other end of the base 10 and includes a mortise 151 for releasably engaging with a tenon 22 on the other end of the cover 20.

The head 15 includes a U-shaped slit 162 formed on an upper side thereof to form a resilient member 16 with a catch 163 on an underside thereof and a rib 161 on an upper side thereof. The head 15 further includes a pair of lugs 18 having a space 18 therebetween and aligned holes 181. A latch member 50 is slidably extended through the left one of the holes 181 (see FIG. 3) and includes a screw hole 51 (FIG. 1). A push pin 60 is slidably extended through the right one of the holes 181 (FIG. 3) and includes a threaded first end 61 engaged with the screw hole 51 of the latch member 50 to slide therewith and a second end beyond the hole 181 for manual operation. As can be seen from FIG. 3, the right hole 181 is stepped for receiving an elastic member 70 that biases the latch member 50 to an operative position to prevent the blade 80 from disengaging from the fixing seat 30.

Figure 6:
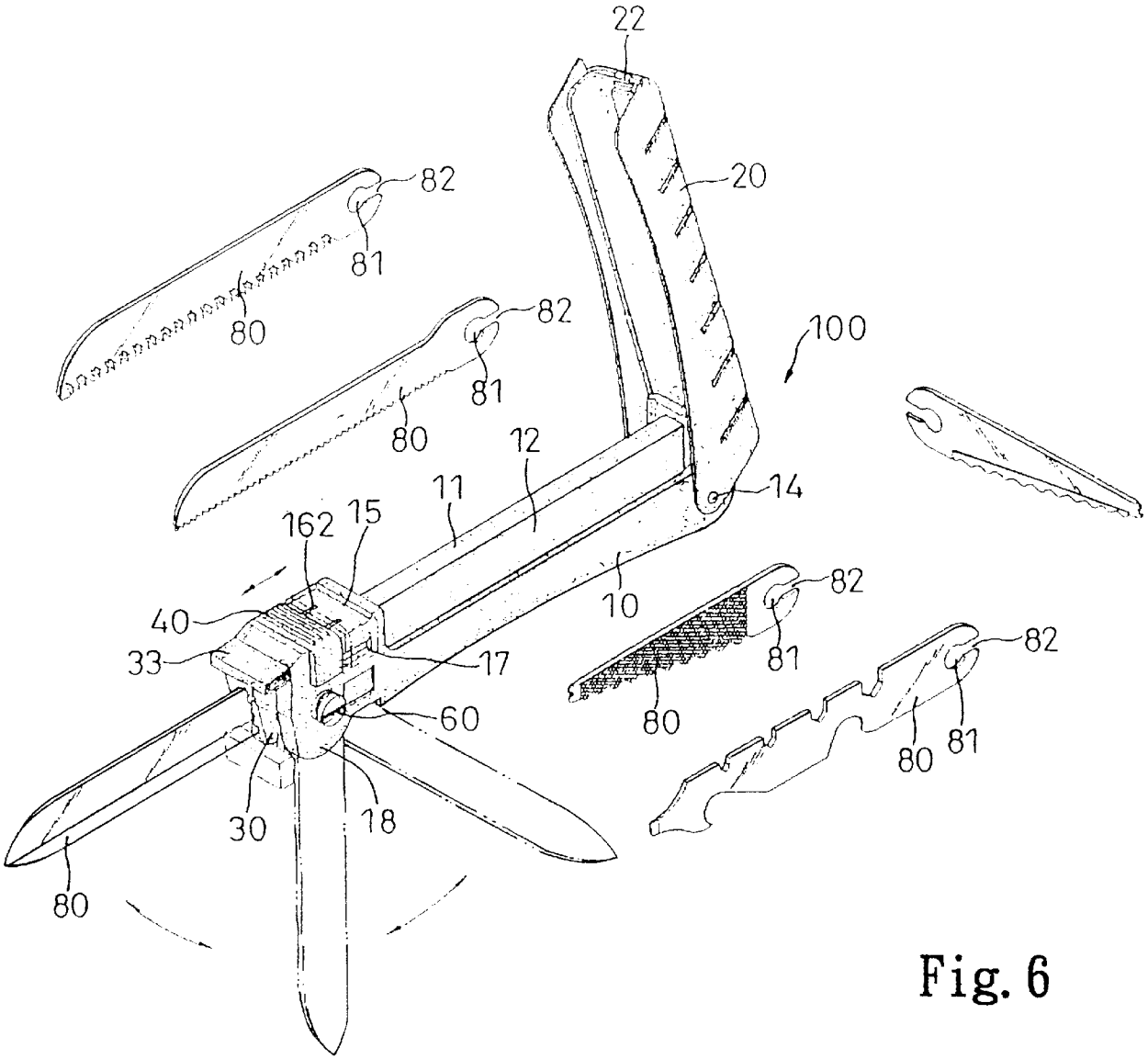
FIG. 6 is an exploded perspective view illustrating different blades that may be received by the tool holder in accordance with the present invention.

Referring to FIGS. 1 and 6, each of the blades 80 includes an engaging hole 81 sized to fittingly receive the latch member 50. A slit 82 extends from the engaging hole 81 to an end edge of the blade 80. The slit 82 is sized to be smaller than a diameter of the latch member 50 and greater than a diameter of the push pin 60.

The fixing seat 30 includes a blade engaging groove 31 for engaging with the end of the blade 80 having the engaging hole 81. The fixing seat 30 further includes bulge 32 having a transverse hole 322 and a tooth-like structure formed on a periphery thereof, thereby forming a plurality of positioning grooves 321. The fixing seat 30 further includes a stop 33 that bears against the head 15. As can be seen from FIG. 3, the transverse hole 322 includes two parts, wherein the left part 322*a* slidably receives the latch member 50 and the right part 322*b* slidably receives the push pin 60, while the hole 81 of the blade 80 locates between the left part 322*a* and the right part 322*b*.

Figure 3:
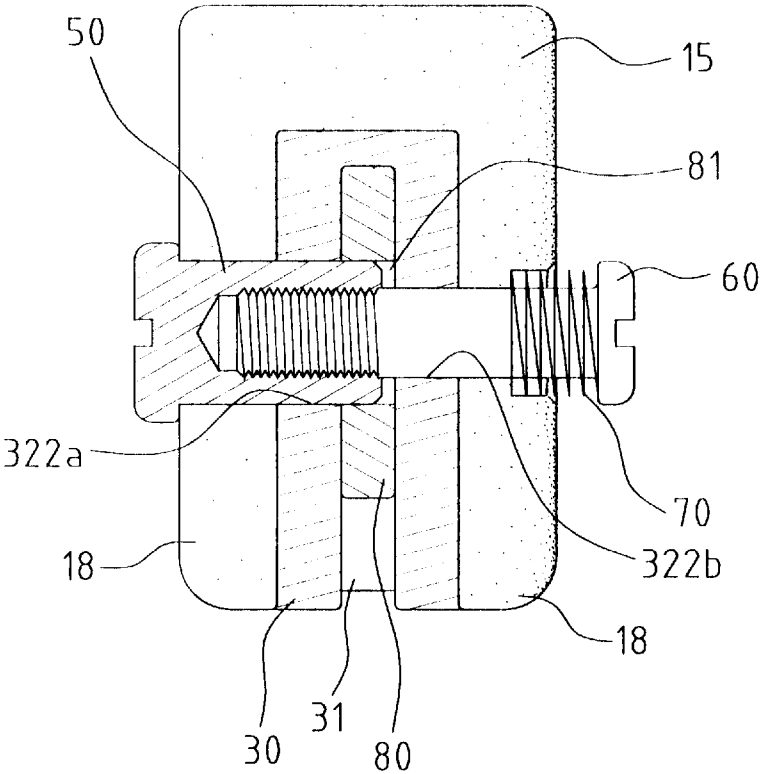
FIG. 3 is a sectional view taken along line 3—3 in FIG. 1, wherein the positioning means is removed for clarity.

Referring to FIG. 3, the bulge 32 of the fixing seat 30 is received in the space 19 between the lugs 18. The push pin 60 is extended through the hole 322 to allow pivotal connection between the fixing seat 30 and the head 15. When replacement of the blade 80 is required, the push pin 60 is pushed leftward (FIG. 4) such that the latch member 50 is moved out of the space 19 between the lugs 18, thereby allowing removal of the blade 80, as the slit 82 has a width greater than the diameter of the push pin 60, best shown in FIG. 4. Then, the engaging end (having the engaging hole 81) of a new blade 80 is inserted into the space 19 between the lugs 18 until the blade 80 reaches a position shown in FIG. 3. Next, the push pin 60 is released such that the latch member 50 moves into the engaging hole 81, as shown in FIG. 3. As a result, the blade 80 is retained in the fixing seat 30.

Turning back to FIG. 2, the head 15 further includes a pair of track means 17 (in the form of two slots) on two lateral sides thereof. A positioning means 40 (a substantially U-shaped member) has two hooks 41 on two lateral sides. The hooks 441 slidably catch the track means 17 and are thus slidable lengthwise on the head 15. In addition, the positioning means 40 is slidable along the upper side of the resilient member 16.

Figure 7:
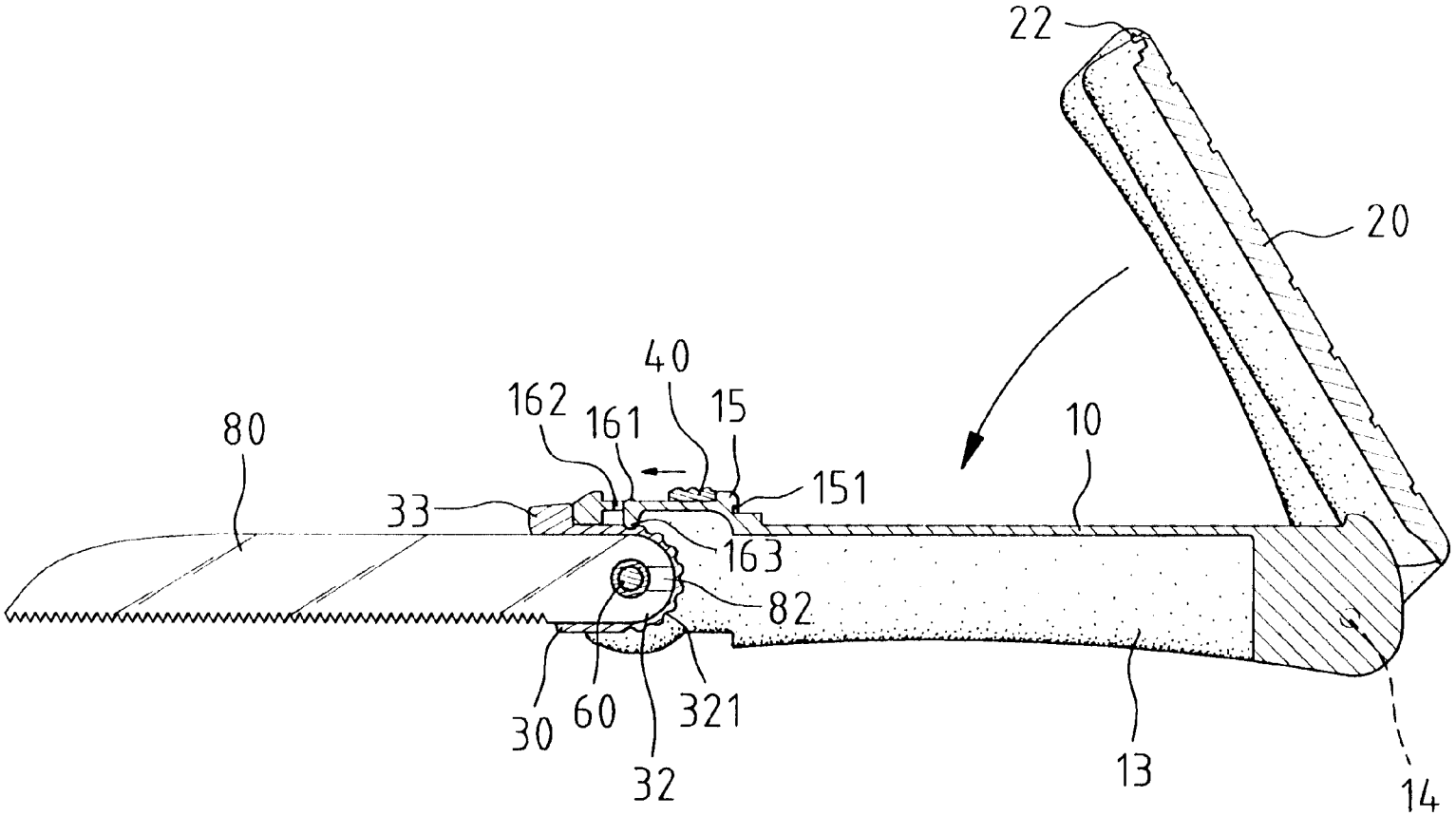
FIG. 7 is a longitudinal sectional view of the tool holder in accordance with the present invention, wherein the positioning means is in an inoperative position.
Figure 8:
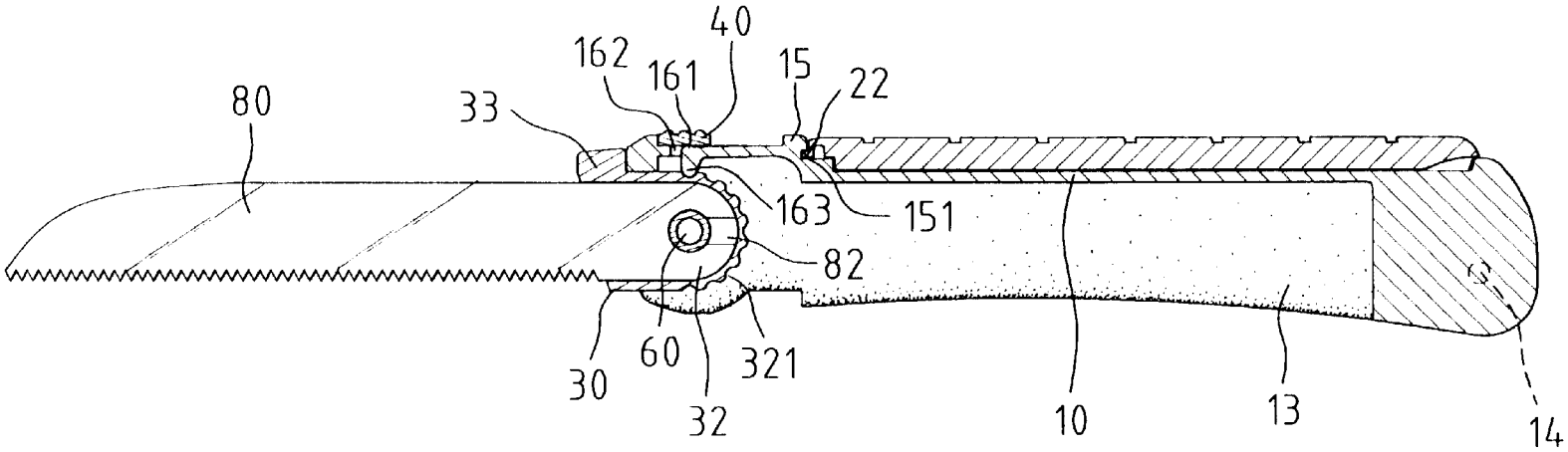
FIG. 8 is a sectional view similar to FIG. 7, wherein the positioning means is in an operative position.
Figure 10:
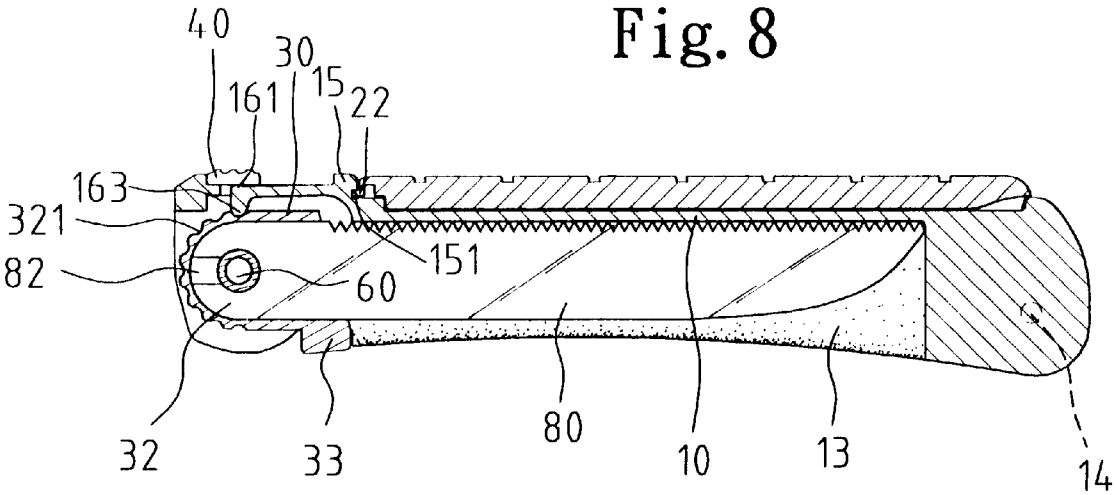
FIG. 10 is a sectional view similar to FIG. 8, wherein the blade is in an operative position.
Figure 9:
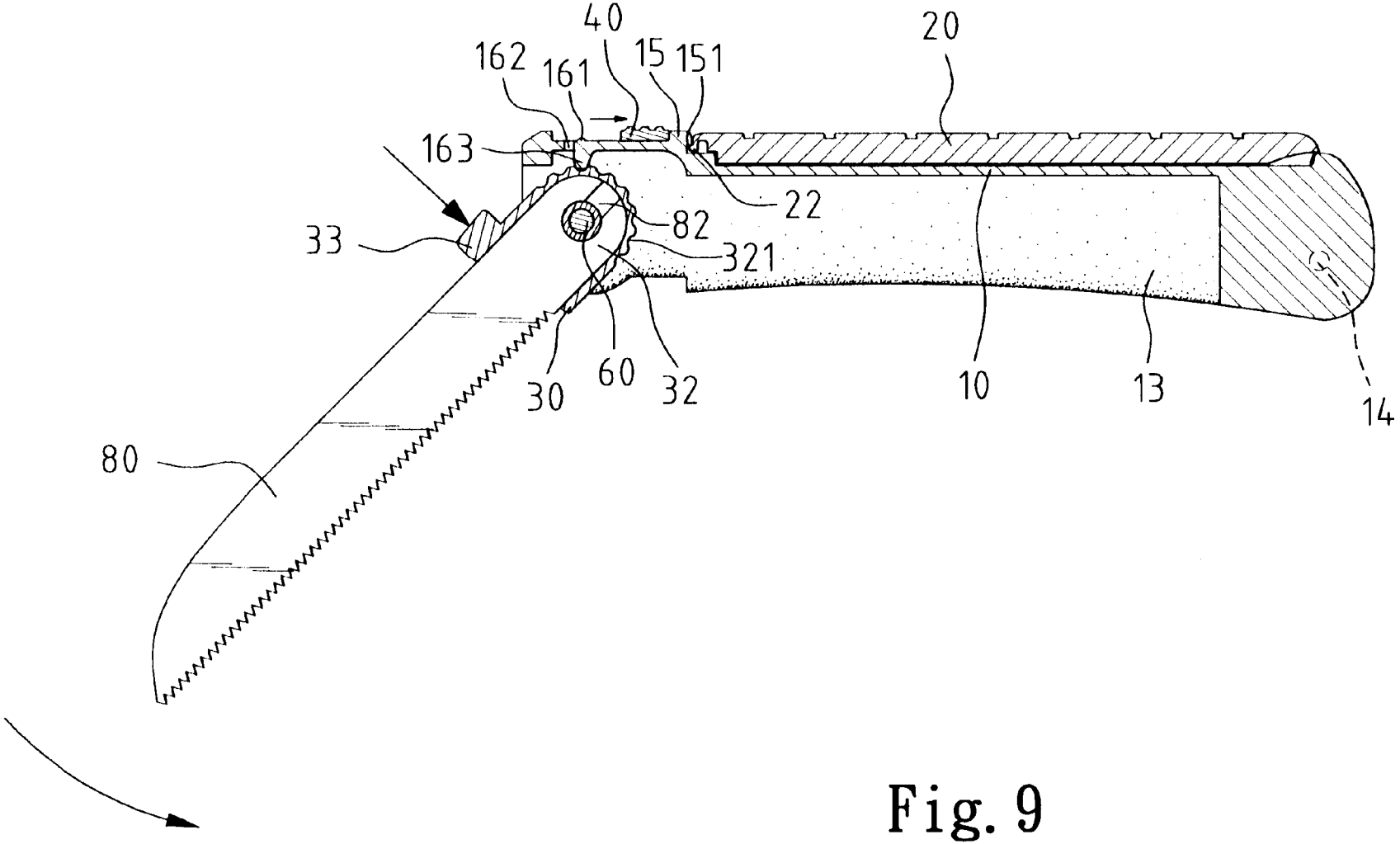
FIG. 9 is a sectional view illustrating folding of the blade.

Turning to FIG. 7, the cover 20 is pivotable relative to the base 10 to allow storage and retrieval of the blades. The positioning means 40 nay be moved from an inoperative position (FIG. 7) to an operative position shown in FIG. 8 in which the positioning means 40 is stopped by an end wall of the head 15. The positioning means 40 in FIG. 8 is over the rib 161 of the resilient member 16 and thus urges the resilient member 16 downward such that the catch 163 of the resilient member 16 firmly engages with one of the positioning hole 321. Thus, the service blade 80 is firmly retained in place for reliable cutting or sawing. When not in use, the positioning means 40 is moved from the operative position to the inoperative position (FIG. 9) such that the catch 163 of the resilient member 16 is disengagable from the positioning grooves 321, thereby allowing pivotal movement of the service blade 80 and the fixing seat 30. Thus, the service blade 80 may be pivoted to a storage position shown in FIG. 10. The positioning means 40 is moved to the operative position again to retain the blade in place.

Although the invention has been explained in relation to its preferred embodiment, it is to be understood that many other possible modifications and variations can be made without departing from the spirit and scope of the invention as hereinafter claimed.

What is claimed is:

1. A tool holder and tools combination, comprising:

a base including a first end and a second end;

a head formed on the second end of the base and including a first compartment for receiving spare tools and a second compartment for receiving a service tool when not in use, each of the tools including an end having an engaging hole and a slit extended from the engaging hole to an end edge of the tool;

a fixing seat pivotally mounted to the head, the fixing seat including a groove for securely holding the end of the service tool; and a pivotal means including a latch member slidably mounted in the head and a push pin having a first end secured to the latch member to move therewith and a second end for manual operation, the engaging hole of each said tool being sized to be smaller than a diameter of the latch member and greater than a diameter of the push pin;

means for biasing the latch member to a position received in the engaging hole of the service tool, thereby preventing removal of the service tool, wherein the push pin is manually operable to cause the latch member out of the engaging hole of the service tool, thereby allowing removal of the service tool from the fixing seat.

2. The tool holder and tools combination as claimed in claim 1, wherein the head includes a pair of spaced lugs having a space therebetween for pivotally receiving the fixing seat.

3. The tool holder and tools combination as claimed in claim 2, wherein the lugs have aligned holes through which the latch member and the push pin slidably extend, respectively.

4. The tool holder and tools combination as claimed in claim 2, wherein the fixing seat includes a bulge pivotally held between the lugs and including a transverse hole through which the latch member and the push pin extend.

5. The tool holder and tools combination as claimed in claim 4, wherein the bulge includes a plurality of positioning grooves, and further comprising a positioning means for retaining the end of the service tool in place.

6. The tool holder and tools combination as claimed in claim 5, wherein the head includes a resilient member on an upper side thereof and a track means formed thereon, the positioning means being slidably mounted to the track means and slidable between an operative position that retains the fixing seat in place and an inoperative position that allows the fixing seat to pivot relative to the head, wherein the resilient member includes a catch for securely engaging with one of the positioning grooves when the positioning means is moved to the operative position, and wherein the catch is releasably engaged with a selected one of the positioning grooves to allow pivotal movement of the fixing seat relative to the head when the positioning means is in the inoperative position.

7. The tool holder and tools combination as claimed in claim 6, wherein the track means includes a pair of slots defined in two lateral sides of the head, respectively.

8. The tool holder and tools combination as claimed in claim 7, wherein the positioning member includes two lateral sides each having a hook for slidingly engaging with an associated slot of the head.

9. The tool holder and tools combination as claimed in claim 1, further comprising a cover having an end pivotally connected with the first end of the base.

10. The tool holder and tools combination as claimed in claim 9, wherein the cover includes a tenon on the other end thereof, and wherein the second end of the base includes a mortise for releasably engaging with the tenon.

11. The tool holder and tools combination as claimed in claim 1, wherein the first compartment is divided by a separation wall into two subcompartments, and wherein the second compartment is defined in an underside of the separation wall.

12. The tool holder and tools combination as claimed in claim 1, wherein the fixing seat includes a transverse hole having a first part that slidably receives the latch member and a second part that slidably receives the push pin, while the engaging hole of the service tool locates between the first part and the second part.

13. A tool holder and tools combination, comprising:

a base including a first end and a second end;

a head formed on the second end of the base and including a first compartment for receiving spare tools and a second compartment for receiving a service tool when not in use, the head including a pair of spaced lugs having a space therebetween and aligned holes, a resilient member on an upper side thereof and a track means formed thereon;

a fixing seat including a bulge with a pivotal hole, the bulge being pivotally mounted in the space of the head, the bulge including a plurality of positioning grooves, the fixing seat including a groove for securely holding an end of the blade; and a positioning means for retaining the end of the service tool in place, the positioning means being slidably mounted to the track means and slidable between an operative position that retains the fixing seat in place and an inoperative position that allows the fixing seat to pivot relative to the head, wherein the resilient member includes a catch for securely engaging with one of the positioning grooves when the positioning means is moved to the operative position, and wherein the catch is releasably engaged with a selected one of the positioning grooves to allow pivotal movement of the fixing seat relative to the head when the positioning means is in the inoperative position.

14. The tool holder and tools combination as claimed in claim 11, wherein each of the tools including an end having an engaging hole and a slit extended from the engaging hole to an end edge of the tool, and further comprising:

a pivotal means including a latch member slidably mounted in the head and a push pin having a first end secured to the latch member to move therewith and a second end for manual operation, the engaging hole of each said tool being sized to be smaller than a diameter of the latch member and greater than a diameter of the push pin; and means for biasing the latch member to a position received in the engaging hole of the service tool, thereby preventing removal of the service tool, wherein the push pin is manually operable to cause the latch member out of the engaging hole of the service tool, thereby allowing removal of the service tool from the fixing seat.

15. The tool holder and tools combination as claimed in claim 11, wherein the track means includes a pair of slots defined in two lateral sides of the head, respectively.

16. The tool holder and tools combination as claimed in claim 15, wherein the positioning member includes two lateral sides each having a hook for slidingly engaging with an associated slot of the head.

17. The tool holder and tools combination as claimed in claim 11, further comprising a cover having an end pivotally connected with the first end of the base.

18. The tool holder and tools combination as claimed in claim 17, wherein the cover includes a tenon on the other end thereof, and wherein the second end of the base includes a mortise for releasably engaging with the tenon.

19. The tool holder and tools combination as claimed in claim 12, wherein the first compartment is divided by a separation wall into two subcompartments, and wherein the second compartment is defined in an underside of the separation wall.

* * * * *